US008376571B2

(12) United States Patent
Rorick

(10) Patent No.: US 8,376,571 B2
(45) Date of Patent: Feb. 19, 2013

(54) EMERGENCY SWITCH FOR A FLASHLIGHT

(76) Inventor: Steven Michael Rorick, Riverside, CA (US)

( * ) Notice: Subject to any disclaimer, the term of this patent is extended or adjusted under 35 U.S.C. 154(b) by 116 days.

(21) Appl. No.: 13/073,106

(22) Filed: Mar. 28, 2011

(65) Prior Publication Data

US 2011/0176296 A1 Jul. 21, 2011

Related U.S. Application Data

(63) Continuation-in-part of application No. 12/395,346, filed on Feb. 27, 2009, now Pat. No. 7,997,756.

(60) Provisional application No. 61/141,582, filed on Dec. 30, 2008.

(51) Int. Cl.
*F21L 4/04* (2006.01)

(52) U.S. Cl. ..... 362/206; 362/205; 200/60

(58) Field of Classification Search ..... 362/204, 362/205, 206, 158; 200/60
See application file for complete search history.

(56) References Cited

U.S. PATENT DOCUMENTS

| | | | | |
|---|---|---|---|---|
| 3,176,092 | A | 3/1965 | Lukasek | |
| 3,377,475 | A | 4/1968 | Frigon | |
| 3,924,116 | A | 12/1975 | Brindley | |
| 4,097,702 | A | 6/1978 | Halsted | |
| 4,256,931 | A | 3/1981 | Palisek | |
| 4,581,686 | A | 4/1986 | Nelson | |
| 4,687,200 | A | 8/1987 | Shirai | |
| 4,823,242 | A | 4/1989 | Maglica et al. | |
| 4,841,417 | A | 6/1989 | Maglica et al. | |
| 4,905,129 | A | 2/1990 | Sharrah | |
| 5,021,934 | A | 6/1991 | Hou | |
| 5,070,438 | A | 12/1991 | Marshall | |
| 5,091,611 | A | 2/1992 | Reeves et al. | |
| 5,122,938 | A | 6/1992 | Pastusek | |
| 5,211,471 | A | 5/1993 | Rohrs | |
| 5,400,227 | A | 3/1995 | Maglica et al. | |
| 5,628,555 | A | 5/1997 | Sharrah | |
| 5,642,932 | A | 7/1997 | Matthews | |
| 5,752,764 | A | 5/1998 | Shiau | |
| 5,984,785 | A | 11/1999 | Takeda et al. | |
| 6,045,236 | A | 4/2000 | Cheng et al. | |
| 6,162,999 | A | 12/2000 | Ishikawa et al. | |
| 6,296,371 | B1 | 10/2001 | Shiau | |
| 6,345,464 | B1 | 2/2002 | Kim | |
| 6,491,409 | B1 | 12/2002 | Sharrah | |
| 6,796,766 | B2 * | 9/2004 | Hesse | 415/157 |
| 6,814,466 | B2 | 11/2004 | Parsons et al. | |
| 6,886,960 | B2 | 5/2005 | Sharrah | |
| 6,976,766 | B2 | 12/2005 | Galli | |
| 7,152,994 | B2 | 12/2006 | Huang | |
| 7,393,120 | B2 | 7/2008 | Kang et al. | |
| 7,581,848 | B1 * | 9/2009 | Parsons et al. | 362/206 |
| 7,997,756 | B2 * | 8/2011 | Rorick | 362/206 |

* cited by examiner

*Primary Examiner* — John A Ward
(74) *Attorney, Agent, or Firm* — Kirk A. Buhler; Buhler & Associates

(57) ABSTRACT

Improvements in an emergency switch for an end cap flashlight that allows conducting power to the light source by applying side or rotational force on the end caps of the flashlight. The cap is designed to give faster and more convenient access to light in an emergency, or when needed. The end cap connects to the inner conductor with a castled shape that allows the conductors to be moved in or out alignment to allow or prevent contact. The gasket or washer provides insulation and spacing of the conductors. Side forces on the end cap overcome the spacing of the washer to make electrical contact. The end cap may also support a glass breaking device. The glass breaker is a hardened tip on the end of the cap.

20 Claims, 5 Drawing Sheets

EMERGENCY SWITCH FOR A FLASHLIGHT

CROSS REFERENCE TO RELATED APPLICATION

This application is a continuation in part of Utility application Ser. No. 12/395,346 filed on Feb. 27, 2009 which claims the benefit of Provisional 61/141,582 filed Dec. 30, 2008 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention:

This invention relates to improvements in a flashlight switch. More particularly the switch allows flashlight to turn on with side pressure or rotation of an end cap of the flashlight.

2. Description of Related Art Including Information Disclosed Under 37 CFR 1.97 and 1.98:

Tail cap switches are limited to very specific grip positions in the hand to gain access to the switch. Also, tail cap switches interfere with placement of a glass breaking device and are not designed to support strike loads Involved in breaking tempered glass. Flashlight switches generally take a number of different types of configurations. In general these three types of configurations are a slide switch, rotational twist and push switches. The push switches can exist on the back or the side of the flashlight. Several products and patents have been. Exemplary examples of patents covering these products are disclosed herein.

A flashlight with a slide switch include U.S. Pat. No. 7,393,120 issued Jul. 1, 2008 to Kang et al., discloses a flashlight with a combination side mounted slide and push switch. While the patent discloses a flashlight switch mechanism the operator is required to hold the flashlight with a finger over the flashlight to operate the switch.

Flashlights with rotational twist to turn on the light include U.S. Pat. No. 4,581,686 issued Apr. 8, 1986 to Normal C. Nelson, U.S. Pat. No. 4,905,129 issued Feb. 27, 1990 to Raymond L. Sharrah, U.S. Pat. No. 5,021,934 issued Jun. 4, 1991 to Hsisn-Der Hou and U.S. Pat. No. 5,122,938 issued Jun. 16, 1992 to Michael J. Pastusek disclose flashlights where turning the front or back of the flash light will conduct power from the batteries to the light source. While these provide switching mechanisms for illuminating the light they do not allow for the light to be illuminated with side motion on the ends of the flashlight.

Flashlights with push switches on the side of the flashlight include U.S. Pat. No. 3,924,166 issued Dec. 2, 1975 to Robert E. Brindley and U.S. Pat. No. 6,814,466 issued Nov. 9, 2004 to Kevin L. Parsons. While these patents disclose switches that operate by pushing on the sides of the body of the flashlight, they do not provide for pushing or tipping horizontally on the end of the flashlight in any direction.

Flashlights with push switches on the back of the flashlight includes U.S. Pat. No. 5,642,932 issued Jul. 1, 1997 to John Wallace Matthews, U.S. Pat. No. 6,296,371 issued Oct. 2, 2001 to Wen-Chin Shiau, U.S. Pat. No. 6,491,409 issued Dec. 10, 2002 and U.S. Pat. No. 6,886,960 on May 3, 2005 both to Raymond L. Sharrah. Pushing the back of the flashlight requires the operator to press on only the back of the flashlight. While this allows for a method to operate the flashlight it does not allow an operator to turn on the flashlight from a variety of positions.

What is needed is a flashlight where the flashlight can be temporally activated by side motion or tipping of one end of the flashlight body. Side motion can be easily placed onto the flashlight with a finger or a hand squeeze.

BRIEF SUMMARY OF THE INVENTION

It is an object of the side action flashlight that allows operation of the flashlight by pressing horizontally on the head or tail of the flashlight. The side activation allows an operator to press on any side of the flashlight ends. The pressing creates an angular rotation of the end cap where it makes contact with the body. This function can be incorporated into either the illumination side or the tail side of the flashlight.

It is an object of the side action flashlight for the bezel of the light output side of the flashlight to have a scalloped or crowned edge. The scalloped edge allows a person to see that the flashlight is on when resting on the top edge of the flashlight. The scalloped top edge also provides a low output of light without requiring an electrical dimming function.

It is an object of the side action flashlight to have an off, temporal on function and an off function. These functions are selected by positioning the end of the flashlight at various positions. An optional detent can be designed into the components to provide a positive feedback mechanism to the user to determine the position of the end cap. The electrical connection components are configured in wave, scalloped or crowed configuration to provide the functions described.

It is another object of the side action flashlight for the flashlight to be waterproof. The design of various switches that require movement or twisting for activation of the light the configuration of the switch provides an opening for water intrusion into the flashlight. The electrical insulating O-ring within the flashlight provides both an electrical isolation of the contacts and a waterproof seal to the inside of the flashlight.

It is still another object of the side action flashlight to include a glass breaker on the end of the flashlight. While the glass breaker does not provide functional operation to the flashlight switch it provides additional function to the flashlight. The proposed switch mechanism is structurally secure enough that repeated use of the glass breaker will not deteriorate the electrical functionality of the switch.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
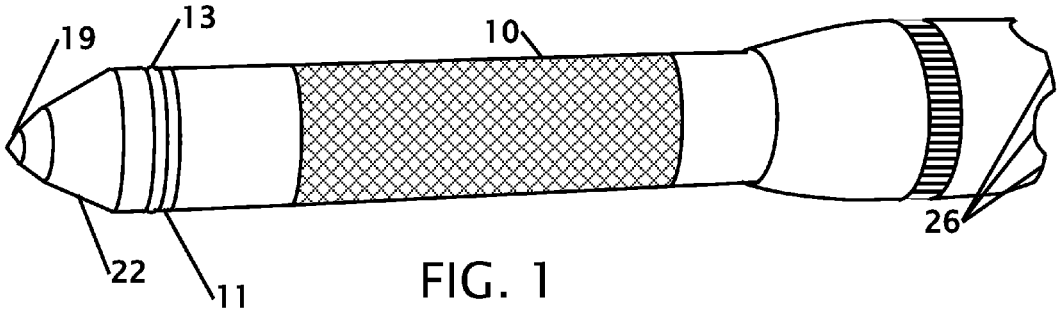
FIG. 1 shows a first perspective view of the emergency switch for a tail cap flashlight.

The preferred embodiment and additional embodiments are described in detail with reference to the related drawings. Further embodiments, features and advantages will become apparent from the ensuing description or may be learned by practicing the invention. In the figures, which are not drawn to scale, like reference characters refer to like features throughout the description. The following description of embodiments, even if phrased in terms of what "the Invention does," is not to be taken in a limiting sense, but is made for the purposes of describing the general principle Invention. The coverage of this patent will be described in the claims.

Figure 2:
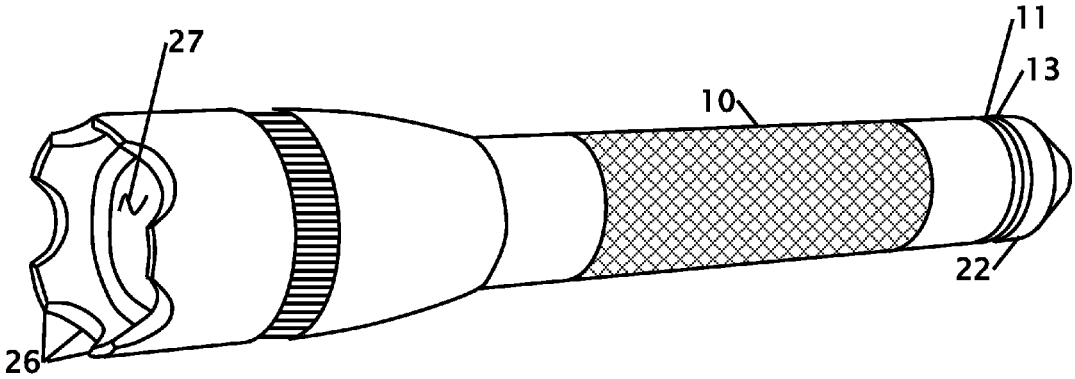
FIG. 2 shows a second perspective view of the emergency switch for a tail cap flashlight.

FIG. 1 shows a first perspective view of the emergency switch for a tail cap flashlight and FIG. 2 shows a second perspective view of the emergency switch for a tail cap flashlight. In general the overall size and shape of the flashlight is similar to other flashlights. The elongated body 10 houses the batteries and one end has an illuminating light source 27 that is power by the internal batteries. In the preferred embodiment the housing that surrounds the illumination end of the flashlight has a scalloped or crowned edge 26. The scalloped edge 26 allows a person to see that the flashlight is on when resting on the illumination edge of the flashlight. The scalloped top edge also provides a dispersed low output of light without requiring an electrical dimming function.

In the preferred embodiment the end cap provides the switch function, but it is also contemplated that the illumination end of the flashlight can have the switch function disclosed and claimed in this application. One embodiment of a tall cap flashlight allows a variety of grip positions and access to a tail cap switch, while also allows incorporation of a glass breaking device 19 that is capable of supporting strike loads sufficient to break tempered glass, should it be required in an emergency.

In these figures, a portion of the inner switch body 11 is shown secured to the flashlight body 10. The O-ring 13 is shown exaggerated in these views to provide a better understanding of its location. The outer switch body 22 with a glass breaker 19 is secured to the inner switch body 11. The accompanying figures provide greater detail on the structure of the switch components.

Figure 3:
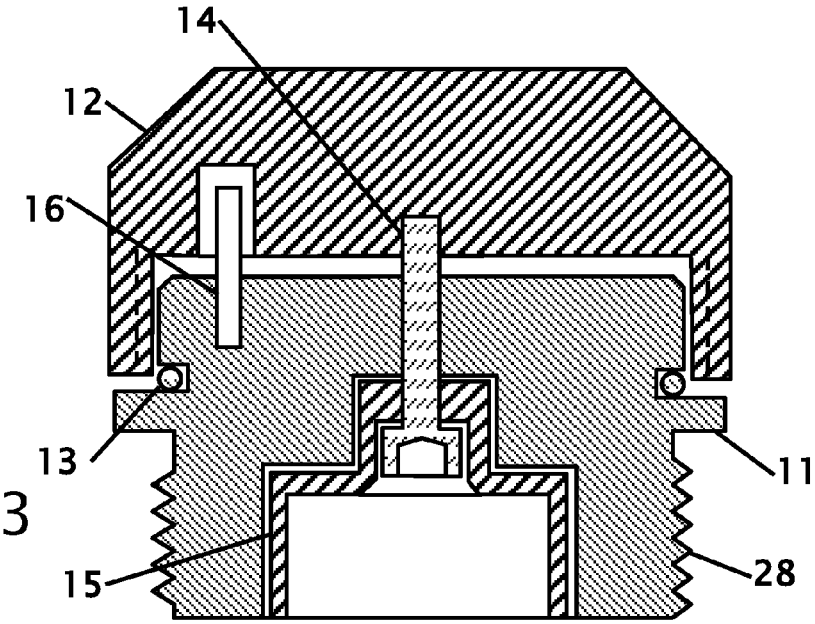
FIG. 3 shows a cross sectional view of the emergency switch components according to a first preferred embodiment.

FIG. 3 shows a cross sectional view of the emergency switch components according to a first preferred embodiment. The end cap is threaded 28 onto the body of a flashlight. One terminal of a battery (Not shown) will fit into insulating washer 15 where the contact of the batter will touch the fastener 14. The fastener 14 threads into the outer switch body or housing 12 being a second conduit. The outer switch body 12 is shown in this figure without a glass breaker. An O-ring 13 insulates and spaces the outer switch housing 12 from the inner switch body or housing 11 being a first conduit. A pin 16 limits rotation of the inner switch body 11 and the outer switch body 12. In the embodiment shown in FIG. 7 the pin is replaced with a spring loaded ball that provides detents for the switch positions.

Figure 4:
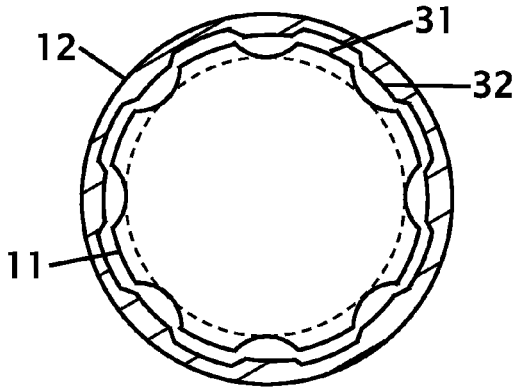
FIG. 4 shows a top view of the scalloped components in an off position.

FIG. 4 shows a top view of the scalloped components in an off position. In the off position the raised inner scallops 31 of the inner switch body 11 are placed out of phase with the raised inner scallops 32 of the outer switch body 12. When side pressure is applied to the outer switch body 12 the pressure is insufficient to overcome the O-ring 13 (See FIG. 3) and the switch can't be activated.

Figure 5:
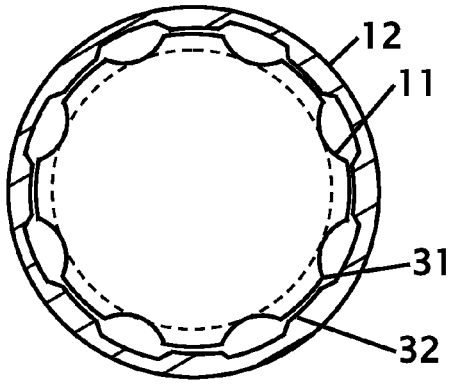
FIG. 5 shows a top view of the scalloped components in a temporally on position.

FIG. 5 shows a top view of the scalloped components in a temporally on position. In the on position the raised inner scallops 31 of the inner switch body 11 are placed in phase with the raised inner scallops 32 of the outer switch body 12. When side pressure is applied to the outer switch body 12 the pressure connects the raised scallop lobes of the switch bodies.

Figure 6:
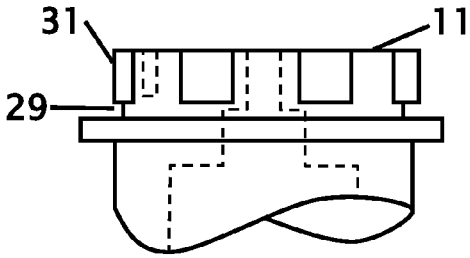
FIG. 6 shows a side view of the inner switch body.

FIG. 6 shows a side view of the inner switch body 11. From this side view a raised lobe 31 is shown extending from the inner switch body 11. The O-ring recess 29 is shown under the extended scallop of lobe 31.

Figure 7:
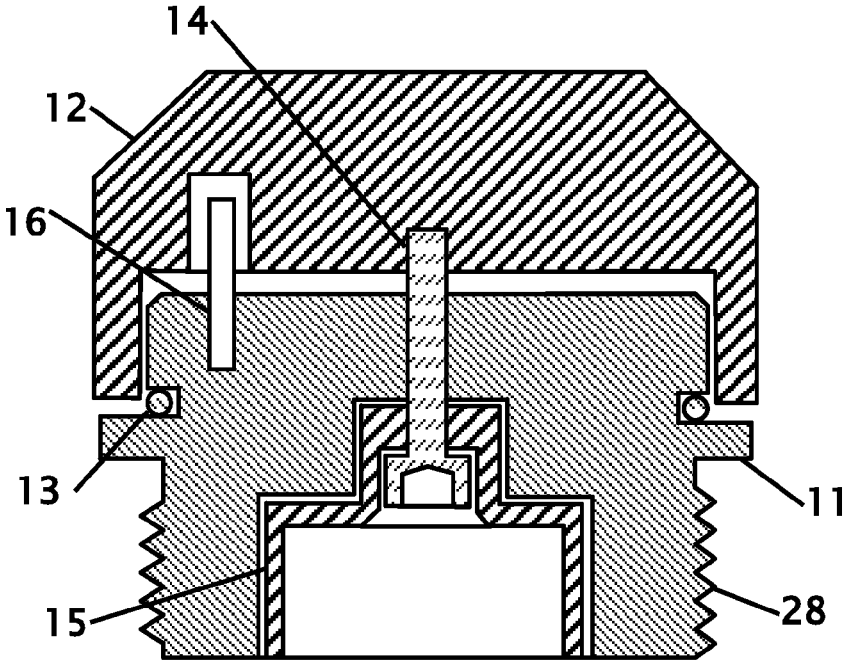
FIG. 7 shows a cross sectional view of the emergency switch components according to a second preferred embodiment.

FIG. 7 shows a cross sectional view of the emergency switch components according to a first preferred embodiment. The end cap is threaded 28 onto the body of a flashlight. One terminal of a battery (Not shown) will fit into insulating washer 15 where the contact of the batter will touch the fastener 14. The fastener 14 threads into the outer switch body or housing 12 being a second conduit. The outer switch body 12 is shown in this figure without a glass breaker. A non-conductive washer 13 insulates and spaces the outer switch housing 12 from the inner switch body or housing 11 being a first conduit. A pin 16 limits rotation of the inner switch body 11 and the outer switch body 12. In the embodiment shown in FIG. 7 the pin is replaced with a spring loaded ball that provides detents for the switch positions.

Figure 8:
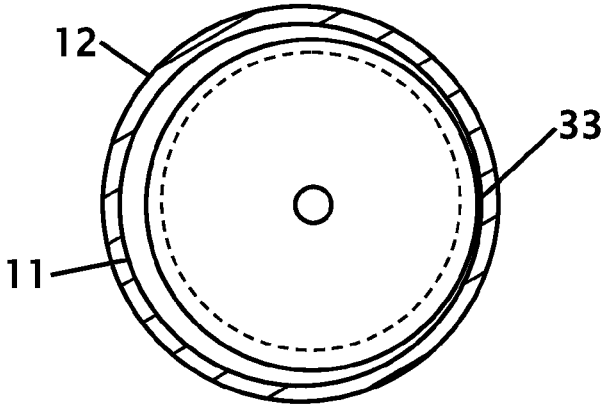
FIG. 8 shows a top view of the switch components.

FIG. 8 shows a top view of the scalloped components in an on position. In this on position the inner switch body 11 is in contact 33 with the outer switch body 12. When side pressure is applied to the outer switch body 12 the pressure is insufficient to overcome the non-conductive insulating washer.

Figure 9:
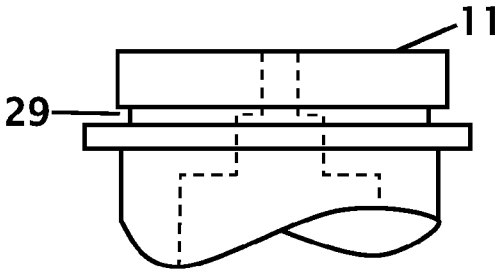
FIG. 9 shows a side view of the inner switch body.

FIG. 9 shows a side view of the inner switch body 11. The non-conductive insulating washer recess 29 is shown under the extended inner switch body 11.

Figure 10:
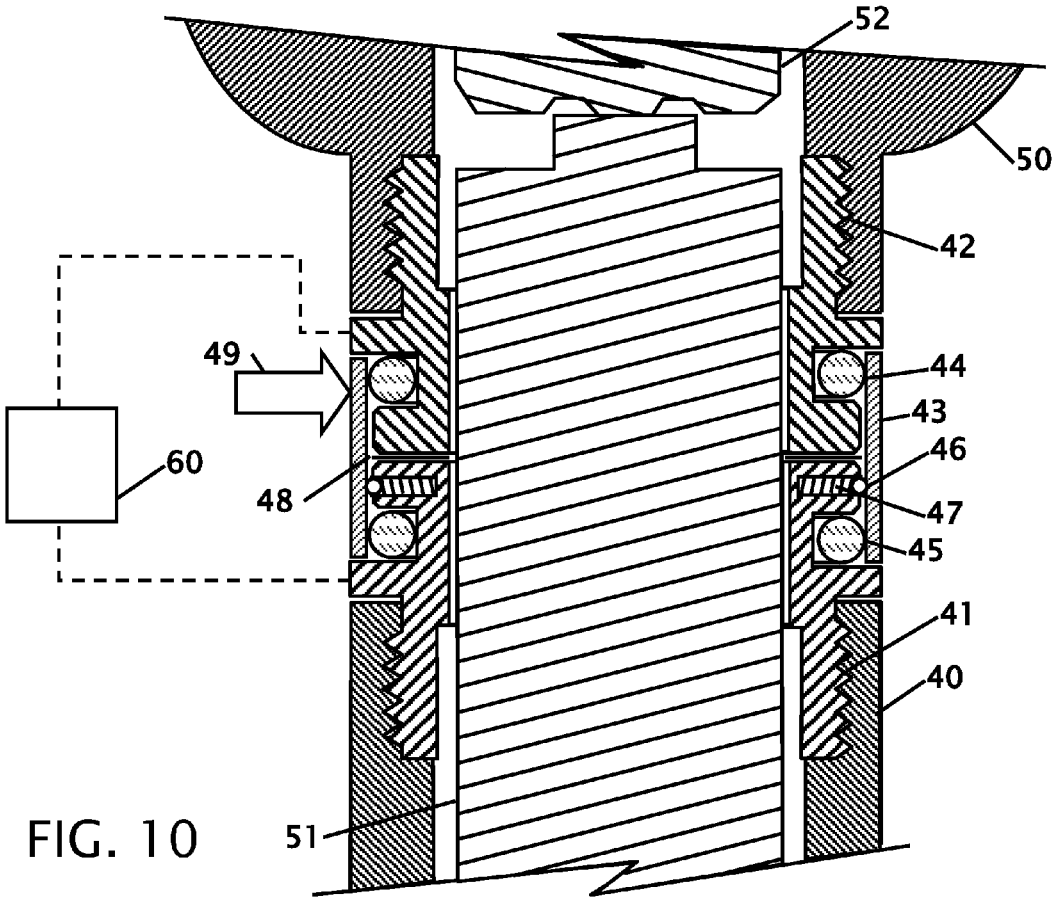
FIG. 10 shows a cross sectional view of another preferred embodiment of the switching mechanism.

FIG. 10 shows a cross sectional view of another preferred embodiment of the switching mechanism. In this figure the flashlight body 40 is shown where the body 40 exists on one side of the switch mechanism and the upper flashlight body 50 exists on the other end of the switch mechanism. While this configuration shows the switch mechanism located near the illumination end of the flashlight, the switch mechanism could also be located at the other end of the flashlight body. The switch mechanism has a first inner switch body 42 having or forming a first conductor. The switch mechanism further has a second inner switch body 41 having or forming a second conductor. At least a portion of these two switch bodies are surrounded by an outer switch body 43 being a third conduit. In the preferred embodiment the third conductor 43 is shown and described as a cylindrical ring, it is contemplated that the third conductor can be formed is a sector, or have a non cylindrical shape such as octagonal or ergonomic shape. The preferred embodiment is cylindrical to allow operation of the switch from normal force being applied from any direction on the third conductor 43.

The first 42 and said second 41 conductors being adapted to be insulated from each other with an insulator/dielectric 48. While a separate insulator 48 is shown, working units have been made with anodized surface that provide the insulation. In the preferred embodiment the second inner switch body 41 is electrically connected to the third conductor 43. The electrical connection is with a spring 47 and a ball, pin or similar contact 46. In another contemplated embodiment the second inner switch 41 and the third conductor 43 is a single integrated unit and can also be formed with the lower flashlight body 40.

One or more deformable insulator(s) 44 and 45 at least temporally insulates the first inner switch body 42 from said third conductor 43 such that when sufficient force or pressure 49 is applied to the third conductor 43 the sufficient force or pressure 49 will deform the deformable insulator(s) 44 and or 45 whereby allowing the third conductor 43 to make electrical contact with the first inner switch body 42.

In this figure one or more batteries 51 can pass through the center of the switch mechanism. The end of the battery 51 is electrically connected to the illumination element 52 either directly or indirectly. In the preferred embodiment a control circuit 60 is connected between the switch conductors. The control circuit 60 allows for various operations of the illumination device including but not limited to constant on, flashing, Morse code signal(s). The control circuit is commanded based upon holding the switch contact closed or multiple closures of the switch contacts to effect the mode of the control circuit 60.

Figure 11:
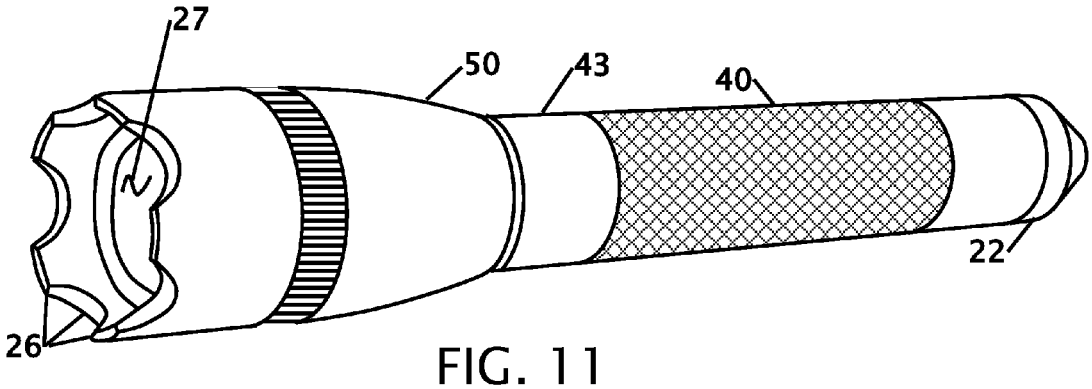
FIG. 11 shows a perspective view of the flashlight with the switch shown in FIG. 10.

FIG. 11 shows a perspective view of the flashlight with the switch shown in FIG. 10. The elongated body 40 houses the batteries and one end has an illuminating light source 27 that is power by the internal batteries the other end of the flashlight includes an optional glass breaker end 22. In the preferred embodiment the housing that surrounds the illumination end of the flashlight has a scalloped or crowned edge 26. The scalloped edge 26 allows a person to see that the flashlight is on when resting on the illumination edge of the flashlight. The scalloped top edge also provides a dispersed low output of light without requiring an electrical dimming function. The third conductor 43 is shown placed near the illumination end 50 of the flashlight to allow an operator to press on the outer switch body from any normal direction to active the flashlight. It is contemplated that the first inner switch body can be integrated with the flashlight body to reduce the number of parts and or simplify the design of the flashlight without detracting from the operation of the switch mechanism.

Figure 12:
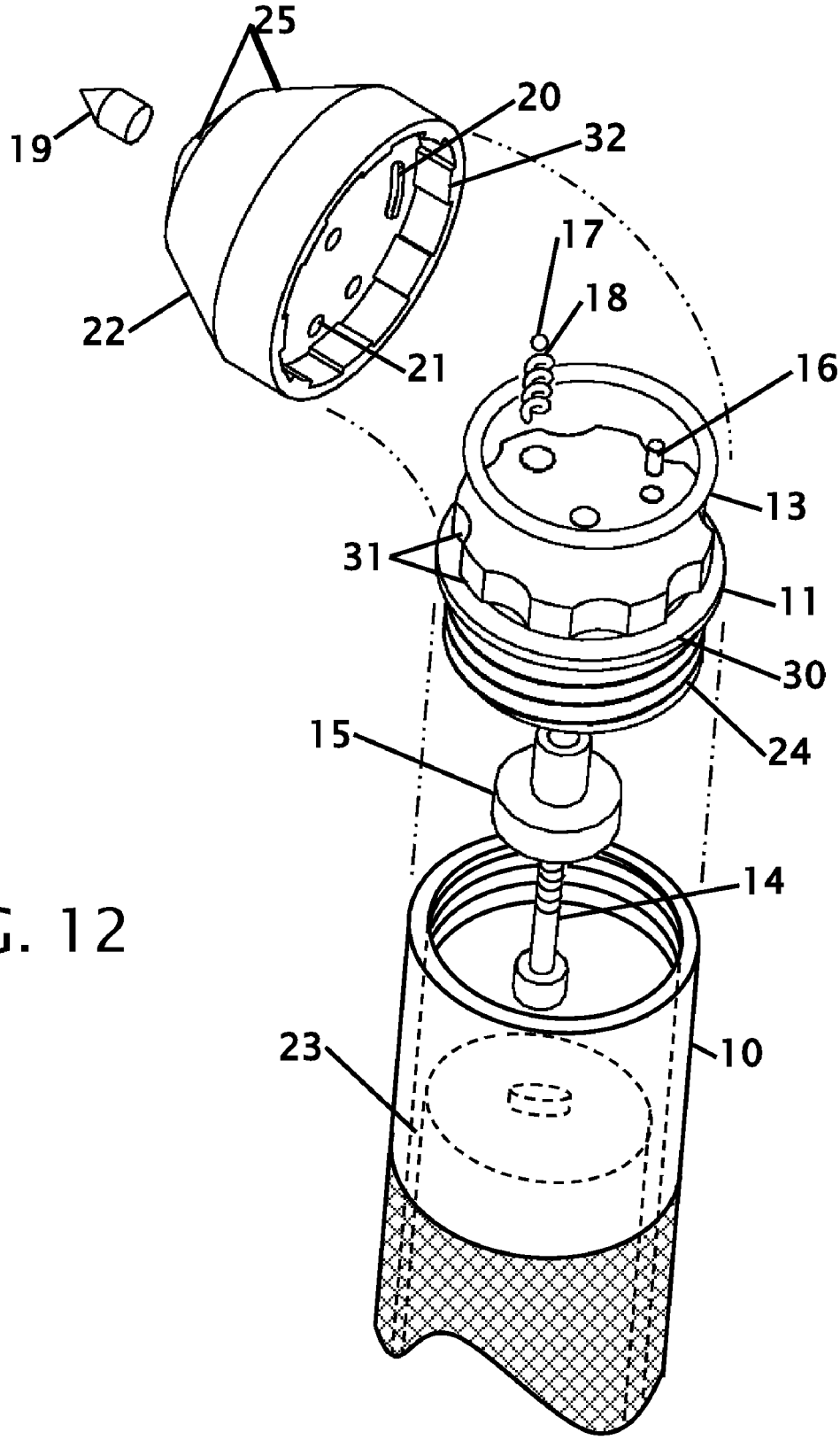
FIG. 12 shows an exploded perspective view of the switching components.

FIG. 12 shows an exploded perspective view of the switching components. As depicted in this figure, a switch is composed of six pieces. Three of the pieces can be purpose built and three pieces are pre-manufactured. The two main components are Inner 11 and outer 22 switch bodies. Both of these pieces are preferably hard anodized aluminum or may be made of any material cast, machined, or molded, such as aluminum, steel, brass, zinc, or plastic when appropriate conduits are present. Various plating may be added to enhance conductivity and control oxidation such as, but not limited to, nickel or gold. Pertaining to the switch bodies, a portion of the anodizing is cut away from specific points of the internal peripheries to allow contact at those points to complete circuit. Also one silicone O-ring 13 is used to center bodies and maintain an open circuit. A single fastener 14 centrally located carries voltage from battery to outer switch body 22 and affixes inner and outer switch bodies 11 and 12 together. The insulating washer 14 is insulated from the inner body by purpose built insulting washer 15. Insulation as mentioned, described as anodized surfaces, may be substituted with other nonconductive materials such as Mylar, phenolic, various coatings and any number of nonconductive substrates.

In one embodiment, though various materials may be used, fashioned by molding, casting or machining on a lathe to create the major components to the switch, machine turning on a lathe from aluminum is the preferred technique. However, molding in plastic with appropriate incorporated conduits may produce mass production solutions. As depicted in the figure after fashioning switch bodies 11 and 22 from chosen material, by chosen method, O-ring 13 would be installed to inner switch body 11 in appropriate groove. Switch bodies 11 and 22 are then fastened to one and other by a single centrally located threaded fastener 14 which acts as conduit from battery source to outer switch body. Power from a battery 23 in the flashlight body 10 is conducted to the fastener 14. The bottom of the inner switch body 14 threads 24 or is pressed into the flashlight body 10.

A ball bearing 17 is pushed by a spring 18 to provide the switch position. The ball bearing travels in a cam shaped recess 20. In the cam shaped recess 20 a series of detents 21 identify the position of the switch as no contact, temporal contact and continuous contact to complete an electric circuit. When the outer switch body 22 is further turned on the inner switch body 11, a continuous contact is made between the outer switch body 12 and the inner switch body 22. The detents 21 gives the user a better sense of switch position when transitioning between modes.

In the embodiment shown a glass breaker 19 is inserted into the end of the outer switch body 22. The top of the outer switch body 22 is formed with a dual angle step 25.

One embodiment of a switch, as for a flashlight of the tail cap variety, is affixed threaded to the back of various flashlights by internal or external threaded configurations. The threaded portion 24 of inner switch body 11 is shouldered 30 and when fastened to back of flashlight, creates continuity between Inner switch body and flashlight body at shouldered point of contact. Outer switch body 12 is attached threaded by central fastener 14 which also acts as conduit from battery 23 to carry voltage to outer switch body 12. The switch can be incorporated with or without a glass breaker 19 in either case access to switch and switch function are Identical. The switch can function with various LED or Incandescent hand held flashlights of the tail Cap variety and is designed to remain in off position until external forces are applied perpendicular to outer switch body or by twisting outer switch body in either direction.

The lobes or scallops 31 and 32 essentially create positive and negative portions of the switch bodies, while in direct contact along a flat plane, are insulted on that plane and, while centered, maintain uncommon polarities. These flat insulated planes are designed to carry high strike loads perpendicular to insulated planes. The switch bodies being cylindrical have an axis, and while centered maintain uncommon polarities (off position). To complete a circuit, forces of as little as 0.6 kg applied perpendicular to axis of cylindrical switch bodies will displace them from common axis, (though in some applications lower forces may be preferable and in other applications greater actuating forces may be more preferable) the movement along the flat Insulated plane will allow contact at uninsulted Internal peripheries (on position). When displacing force is removed from switch body, the switch bodies will return to common axis and disconnect circuit. To complete the circuit, force may be applied at any point radial perpendicular to outer switch body.

In one embodiment, when Installed to the back of a flashlight, pressure to the outer switch body by the thumb or while griped In one hand and forcing the side of the outer switch body In the palm of the hand with the fingers of the same hand will close circuit creating (on) position until side pressure is released, at which point switch will return to off position automatically.

Thus, specific embodiments of an emergency switch for a tail cap flashlight have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An switch for a flashlight comprising:

a flashlight body;

a first inner switch body having a first conductor;

a second inner switch body having a second conductor;

an outer switch body being a third conductor;

said first and said second conductors being adapted to be insulated from each other;

said second inner switch body being electrically connected to said outer switch body;

a deformable insulator that at least temporally insulates said first inner switch body from said outer switch body such that when sufficient force or pressure is applied to said outer switch body said sufficient force or pressure will deform said deformable insulator whereby allowing said outer switch body to make electrical contact with said first inner switch body.

2. The switch for a flashlight according to claim 1 that further includes a connection from said first inner switch body and said second inner switch body to a control circuit.

3. The switch for a flashlight according to claim 2 wherein said control circuit can electrically connect said first inner switch body to said second inner switch body.

4. The switch for a flashlight according to claim 3 wherein when said electrical connection from said control circuit is continuous.

5. The switch for a flashlight according to claim 3 wherein when said electrical connection from said control circuit is intermittent.

6. The switch for a flashlight according to claim 3 wherein when said electrical connection from said control circuit is intermittent.

7. The switch for a flashlight according to claim 1 wherein said outer switch body exists cylindrically around said flashlight body.

8. The switch for a flashlight according to claim 7 wherein said sufficient force is normal to said outer switch body.

9. The switch for a flashlight according to claim 7 wherein said sufficient force allows said electrical contact from sufficient normal force on said outer switch body placed on said inner switch body around said outer switch body.

10. The switch for a flashlight according to claim 2 wherein a duration of making electrical contact effects operation of said control circuit.

11. The switch for a flashlight according to claim 2 wherein a number of making electrical contacts effects operation of said control circuit.

12. The switch for a flashlight according to claim 1 that further includes a compliant conductor located between said second inner switch body and said outer switch body.

13. The switch for a flashlight according to claim 1 wherein said compliant conductor is a spring loaded ball or pin.

14. The switch for a flashlight according to claim 1 wherein said outer switch body further includes an embedded glass breaker.

15. The switch for a flashlight according to claim 14 wherein said outer switch body has a dual angle step to said glass breaker.

16. The switch for a flashlight according to claim 1 wherein said flashlight has a scalloped illumination end.

17. The switch for a flashlight according to claim 1 wherein said second conductor and said outer switch body is a single component or assembly.

18. The switch for a flashlight according to claim 1 wherein said force can be applied from any side direction onto said outer switch body.

19. The switch for a flashlight according to claim 1 wherein said emergency switch is incorporated into the non-illuminating end of the flashlight.

20. The switch for a flashlight according to claim 1 wherein said emergency switch is incorporated into the illuminating end of the flashlight.

* * * * *